US006776692B1

(12) United States Patent
Zuniga et al.

(10) Patent No.: US 6,776,692 B1
(45) **Date of Patent: *Aug. 17, 2004**

(54) CLOSED-LOOP CONTROL OF WAFER POLISHING IN A CHEMICAL MECHANICAL POLISHING SYSTEM

(75) Inventors: Steven Zuniga, Soquel, CA (US); Manoocher Birang, Los Gatos, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/609,426

(22) Filed: Jul. 5, 2000

Related U.S. Application Data

(60) Provisional application No. 60/143,219, filed on Jul. 9, 1999.

(51) Int. Cl.[7] ..... B24B 1/00

(52) U.S. Cl. ..... 451/41; 451/5; 451/8; 451/11; 451/285; 451/286; 451/287; 451/288; 451/289

(58) Field of Search ..... 451/5, 8, 11, 41, 451/285, 286, 287, 288, 289

(56) References Cited

U.S. PATENT DOCUMENTS 5,081,796 A 1/1992 Schultz
5,486,129 A * 1/1996 Sandhu et al. ..... 451/5
5,658,183 A 8/1997 Sandhu et al.
5,730,642 A 3/1998 Sandhu et al.
5,985,094 A * 11/1999 Mosca ..... 156/345
6,159,073 A 12/2000 Wiswesser et al.
6,422,927 B1 7/2002 Zuniga

FOREIGN PATENT DOCUMENTS

| | | |
|---|---|---|
| DE | 3801969 A | 7/1989 |
| EP | 0879678 A | 11/1998 |
| EP | 0904895 A | 3/1999 |
| JP | 0914828 | 6/1997 |

* cited by examiner

*Primary Examiner*—Joseph J. Hail, III
*Assistant Examiner*—Sharitese McDonald
(74) *Attorney, Agent, or Firm*—Fish & Richardson

(57) ABSTRACT

Techniques for polishing a wafer (10) include closed-loop control. The wafer can be held by a carrier head (100) having at least one chamber whose pressure is controlled to apply a downward force on the wafer. Thickness-related measurements of the wafer can be obtained during polishing and a thickness profile for the wafer is calculated based on the thickness-related measurements. The calculated thickness profile is compared to a target thickness profile. The pressure in at least one carrier head chamber is adjusted based on results of the comparison. The carrier head chamber pressures can be adjusted to control the amount of downward force applied to the wafer during polishing and/or to control the size of a loading area on the wafer against which the downward force is applied.

22 Claims, 8 Drawing Sheets

20
76
100
70
74
10
60
66
74
10
100
70
74
62
74
100
70
100
10
70
10
64
39
30
24
36
22
28
36
28
38
39
30
22
39
36
24
38
38
24
30
22
62
28
23

CLOSED-LOOP CONTROL OF WAFER POLISHING IN A CHEMICAL MECHANICAL POLISHING SYSTEM

CROSS REFERENCE TO RELATED APPLICATIONS

This Application claims the benefit of priority of U.S. Provisional Application No. 60/143,219, filed Jul. 9, 1999.

BACKGROUND

The present invention relates generally to chemical mechanical polishing of substrates, and more particularly to closed-loop control of wafer polishing in a chemical mechanical polishing system.

Integrated circuits are typically formed on substrates, particularly silicon wafers, by the sequential deposition of conductor, semiconductor or insulator layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The effectiveness of a CMP process can be measured by its polishing rate, and by the resulting finish (absence of small-scale roughness) and flatness (absence of large-scale topography) of the wafer surface. The polishing rate, finish and flatness are determined by the pad and slurry combination, the relative speed between the wafer and pad, and the force pressing the wafer against the pad.

A recurring problem in CMP is the "edge-effect," in other words, the tendency of the wafer edge to be polished at a different rate than the wafer center. The edge effect typically results in non-uniform polishing at the wafer perimeter, for example, the outermost three to fifteen millimeters of a 200 millimeter (mm) wafer. A related problem is the "center slow effect," in other words, the tendency of the center of the wafer to be underpolished.

Other factors also contribute to non-uniformity in the CMP process. For example, CMP processes are sensitive to differences among polishing pad from different lots, variations in batches of slurry, and process drifts that occur over time. In addition, CMP processes may vary with depending on environmental factors, such as temperature. The particular condition of the wafer and films deposited on the wafer also contribute to variations in the CMP process. Similarly, mechanical changes to the CMP system can affect the uniformity of the CMP process. Variations in the CMP process may occur slowly over time, for example, as a result of wear to the polishing pad. Other variations may occur as a result of a sudden change, such as when a new batch of slurry or a new polishing pad is used.

Using current techniques, it has been difficult to compensate for the foregoing variations in CMP processes to control wafer thickness dynamics. In particular, it has been difficult to control CMP processes to obtain a desired flatness or topography of the wafer surface. Similarly, it has been difficult to control CMP processes to obtain repeatable results for numerous wafers over a long period of time.

SUMMARY

In general, according to one aspect, a method of polishing a wafer uses closed-loop control. The wafer can be held by a carrier head having at least one chamber whose pressure is controlled to apply a downward force on the wafer. The method includes obtaining thickness-related measurements of the wafer and calculating a thickness profile for the wafer based on the thickness-related measurements. The calculated thickness profile is compared to a target thickness profile. The pressure in at least one carrier head chamber is adjusted based on results of the comparison.

In another implementation, a polishing method can be used with a wafer held by a carrier head having multiple chambers that can apply independently variable pressures to multiple regions of the wafer. The method includes obtaining thickness-related measurements of the wafer during polishing and adjusting a pressure in one of the carrier head chambers associated with a particular zone of the wafer based on the thickness-related measurements.

A chemical mechanical polishing system also is disclosed. The system includes a wafer polishing surface and a carrier head for holding a wafer. The carrier head includes at least one chamber whose pressure can be controlled to apply a downward pressure on the wafer as it is polished against the polishing surface. The system also has a monitor for obtaining thickness-related measurements of the wafer during polishing and memory that stores a target thickness profile. A processor is configured to: (a) calculate a thickness profile for the wafer based on a thickness-related profile obtained by the monitor; (b) compare the calculated thickness profile to a target thickness profile; and (c) adjust a pressure in at least one carrier head chamber based on results of the comparison.

In general, the chamber pressures can be adjusted in real time as a particular wafer is being polished. Thus, thickness measurements can be obtained simultaneously with polishing of the wafer, and the chamber pressure can be adjusted without removing the wafer from the polishing surface. In other implementations, thickness-related measurements of a sample wafer can be obtained and compared to the target profile so that adjustments to the chamber pressures can be made prior to or during polishing of other wafers.

In various implementations, one or more of the following features may be present. Adjusting a carrier head chamber pressure can change the pressure distribution between the wafer and a polishing surface. The carrier head can include a flexible membrane which provides a pressure to the wafer in a controllable loading area so that adjusting a chamber pressure can control the pressure applied to a wafer in the loading area. For example, if comparing the calculated thickness profile to a target thickness profile indicates that a center region of the wafer is being underpolished, then a pressure in one of the carrier head chambers can be adjusted to reduce the size of the loading area.

Similarly, adjusting a carrier head chamber pressure can change a downward force with which the wafer is pressed against the polishing surface.

Obtaining thickness-related measurements of the wafer can include measuring intensities of reflected radiation from multiple sampling zones on the wafer. The target thickness profile can represent, for example, either an ideal thickness profile or an expected thickness profile for a particular time in the polishing process.

Additionally, obtaining thickness-related measurements, calculating a thickness profile, comparing the calculated thickness profile to a target thickness profile, and adjusting a pressure in at least one of the carrier head chambers can be repeated multiple times during processing of a particular wafer.

Various implementations can include one or more of the following advantages. Variations in the wafer polishing process, such as environmental variations, variations in wafers and slurries, and variations in the CMP apparatus itself can be compensated for to provide a more uniform and more planar surface. Similarly, variations in the rate at which different regions of wafers are polished can be compensated for more easily. Although it will often be desirable to compensate for such variations so as to obtain a substantially planar surface, it may be desirable in some cases to vary the carrier head chamber pressures so that different regions of the wafer are polished to different thicknesses.

Other features and advantages will be readily apparent from the detailed description, drawings and claims.

DETAILED DESCRIPTION

Figure 1:
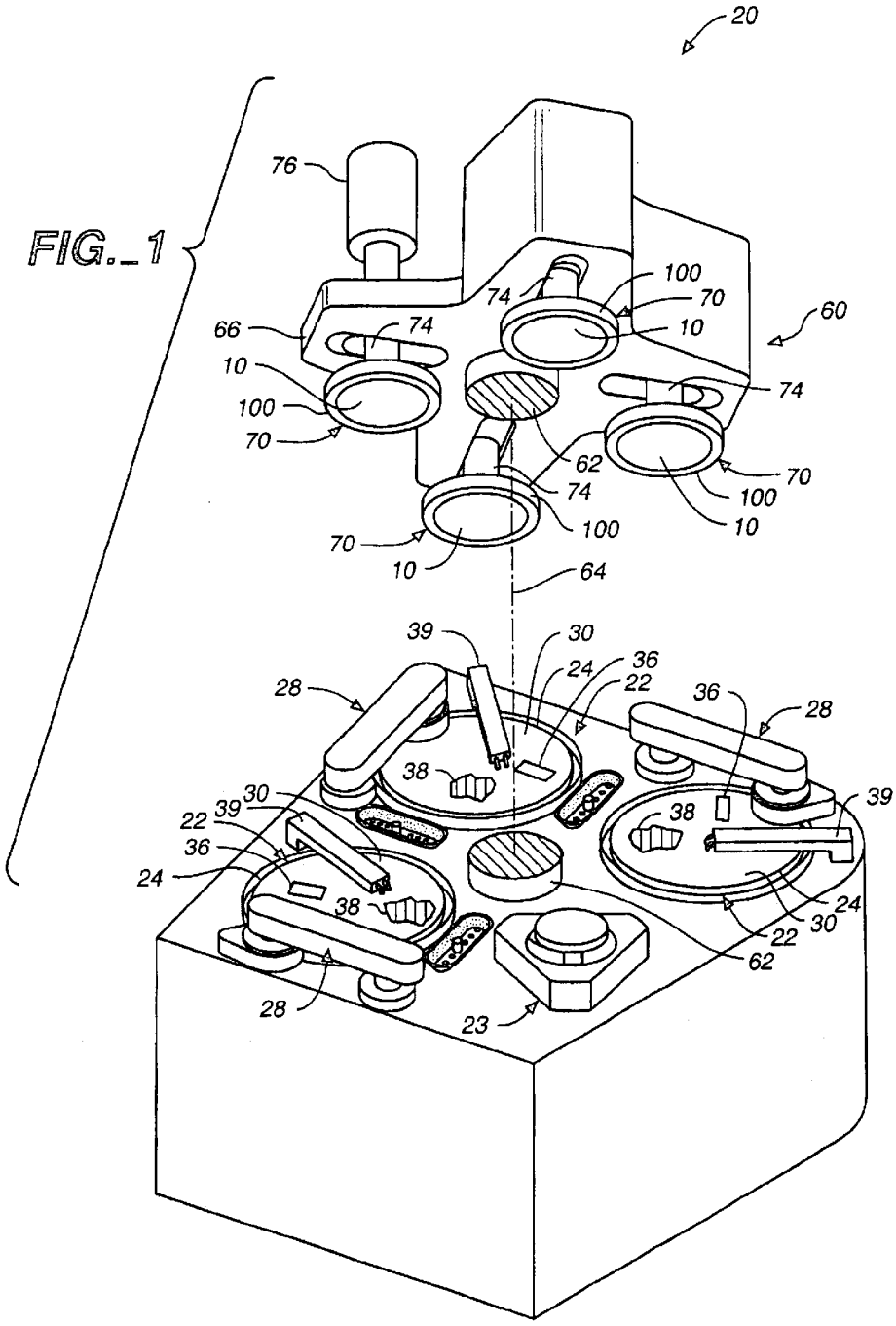
FIG. 1 is an exploded perspective view of a chemical mechanical polishing apparatus.

As shown in FIG. 1, multiple semiconductor wafers 10 are polished by a chemical mechanical polishing (CMP) apparatus 20. Each wafer 10 may have one or more previously-formed films of layers. The polishing apparatus 20 includes a series of polishing stations 22 and a transfer station 23. The transfer station 23 serves multiple functions, including receiving individual wafers 10 from a loading apparatus (not shown), washing the wafers, loading the wafers into carrier heads, receiving the wafers from the carrier heads, washing the wafers again, and finally, transferring the wafers back to the loading apparatus.

Figure 2:
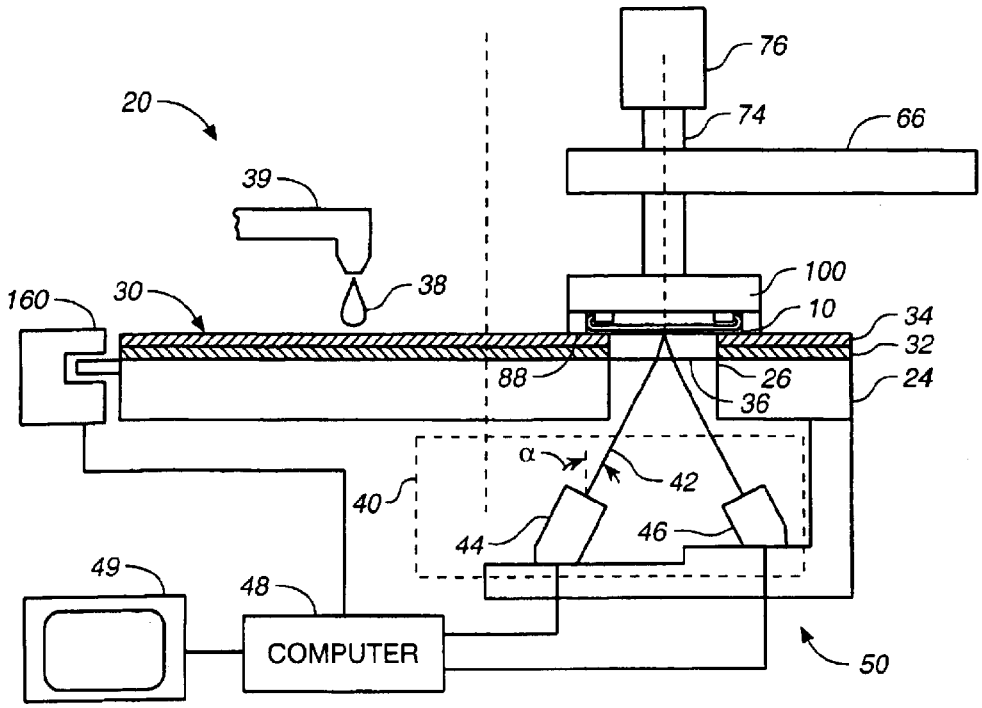
FIG. 2 is a side view of an exemplary chemical mechanical polishing apparatus including an optical interferometer for use in the invention.

Each polishing station includes a rotatable platen 24 on which is placed a polishing pad 30. The polishing pads 30 can include a backing layer 32 and a covering layer 34 (FIG. 2). Each platen 24 can be connected to a platen drive motor (not shown). For most polishing processes, the platen drive motor rotates platen 24 at thirty to two hundred revolutions per minute, although lower or higher rotational speeds may be used. Each polishing station may also include a pad conditioner apparatus 28 to maintain the condition of the polishing pad so that it will effectively polish wafers. Combined slurry/rinse arms 39 can supply slurry to the surface of the polishing pads 30.

A rotatable multi-head carousel 60 is supported by a center post 62 and is rotated thereon about a carousel axis 64 by a carousel motor assembly (not shown). The carousel 60 includes four carrier head systems 70. The center post 62 allows the carousel motor to rotate carousel support plate 66 and to orbit the carrier head systems and the wafers attached thereto about the carousel axis 64. Three of the carrier head systems receive and hold wafers, and polish them by pressing them against the polishing pads. Meanwhile, one of the carrier head systems receives a wafer from and delivers a wafer to transfer station 23.

At least one of the stations includes an in situ rate monitor that is capable of obtaining data and calculating thickness-related information about the wafer during the CMP process. One such thickness measuring technique is disclosed in U.S. patent application Ser. No. 09/184,775, filed on Nov. 2, 1998, and assigned to the assignee of the present invention. That application, which describes an in situ, real-time measuring apparatus and technique that can be used to provide a radial profile or diameter scan of thickness-related measurements of the wafer, is incorporated herein by reference. As described below, the wafer thickness-related data obtained by the in situ thickness monitor is used as feedback data for a CMP control system.

One implementation of an in situ thickness monitor 50 is shown in FIG. 2. A hole 26 is formed in the platen 24, and a transparent window 36 is formed in a portion of the polishing pad 30 overlying the hole. An optical monitoring system 40 is secured to the platen 24 generally beneath the hole 26 and rotates with the platen. The optical monitoring system 40, which can use interferometry, includes a light source 44, such as a laser, and a detector 46. The light source 44 generates a light beam 42 which propagates through the transparent window 36 and slurry 38 to impinge upon the exposed surface of the wafer 10. A position sensor 160, such as an optical interrupter, can be used to sense when the window 36 is near the wafer 10. Other techniques, including spectrophotometry, can be used to obtain thickness-related measurements of the wafer.

In operation, the CMP apparatus 20 can use the thickness monitor 50 to determine the amount of material that has been removed from the surface of the wafer 10, the remaining thickness of a thin film layer, or the range of thicknesses across the wafer surface. The apparatus 20 also can determine the within wafer non-uniformity, in other words, the standard deviation in the thicknesses removed divided by the average thickness removed, multiplied by 100%. Additionally, the apparatus 20 can determine when the surface has become planarized.

A general purpose programmable digital computer 48 is coupled to the laser 44, the detector 46 and the position sensor 160. The computer 48 can be programmed to activate the laser when the wafer generally overlies the window 36, to store intensity measurements from the detector, to display the intensity measurements on an output device 49, to calculate the initial thickness, polishing rate, amount removed and remaining thickness based on the intensity measurements, and to detect the polishing endpoint. Additionally, as discussed in greater detail below, the computer 48 is programmed to use the feedback data obtained from the optical monitoring system 40 to adjust the pressure (s) applied to the back surface of the wafer 10 during polishing.

Because the thickness of the thin film layer varies with time as the wafer is polished, the signal output from the detector 46 also varies with time. The time varying output of the detector 46 can be referred to as an in-situ reflectance measurement trace and can be used to determine the thickness of the wafer layers.

In general, the optical monitoring system 40 measures the intensity of reflected radiation from multiple sampling zones on the wafer 10. The radial position of each sampling zone is calculated, and the intensity measurements are sorted into radial ranges. Once a sufficient number of intensity measurements have been accumulated for a particular radial range, a model function is calculated from the intensity measurements for that range. The model function can be used to calculate the initial thickness, polishing rate, remaining thickness, and amount removed. In addition, a measure of the flatness of a film deposited on the wafer can be calculated. Further details are described in the previously-mentioned U.S. patent application Ser. No. 09/184,775. Alternative techniques also can be used to obtain a radial profile of the wafer thickness.

Referring again to FIG. 1, each carrier head system includes a carrier head 100. A carrier drive shaft 74 connects a carrier head rotation motor 76 to each carrier head 100 so that each carrier head can independently rotate about it own axis. Each carrier head has an associated carrier drive shaft and motor. The carrier head 100 performs several mechanical functions. Generally, the carrier head holds the substrate against the polishing pad, distributes a downward pressure across the back surface of the substrate, transfers torque from the drive shaft to the substrate, and ensures that the substrate does not slip out from beneath the carrier head during polishing operations.

Additionally, each of the carrier heads 100 has a controllable pressure and loading area which allows the downward pressure applied to the back of the wafer to be varied. A suitable carrier head is described in U.S. patent application Ser. No. 09,470,820, filed on Dec. 23, 1999 and assigned to the assignee of the present invention. The disclosure of that application is incorporated herein by reference.

Figure 3:
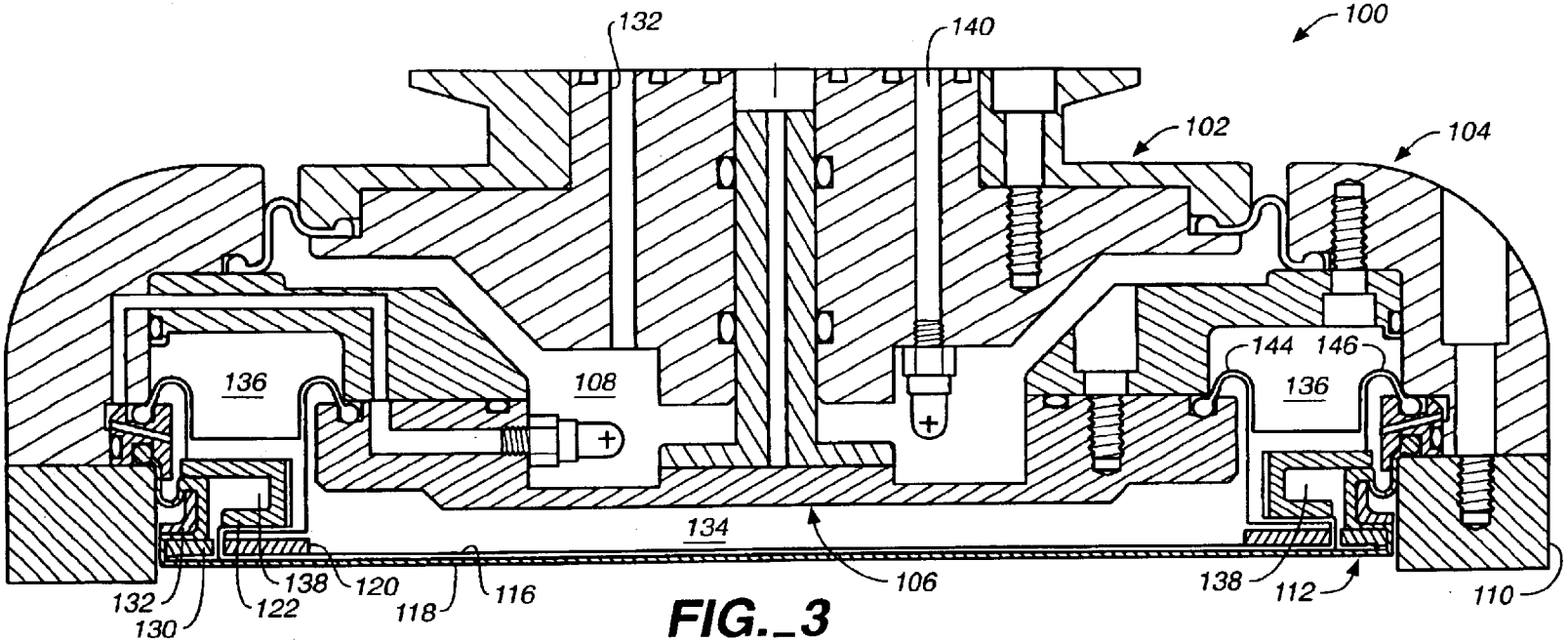
FIG. 3 is a schematic cross-sectional view of an exemplary carrier head for use in the invention.

As disclosed in the foregoing patent application and as shown in FIG. 3, an exemplary carrier head 100 includes a housing 102, a base assembly 104, a gimbal mechanism 106, a loading chamber 108, a retaining ring 110, and a substrate backing assembly 112 which includes three pressurizable chambers, such as a floating upper chamber 136, a floating lower chamber 134, and an outer chamber 138.

The loading chamber 108 is located between the housing 102 and the base assembly 104 to apply a load, in other words, a downward pressure or weight, to the base assembly 104. A first pressure regulator (not shown) can be fluidly connected to the loading chamber 108 by a passage 132 to control the pressure in the loading chamber and the vertical position of base assembly 104.

A wafer backing assembly 112 includes a flexible internal membrane 116, a flexible external membrane 118, an internal support structure 120, an external support structure 130, an internal spacer ring 122 and an external spacer ring 132. The flexible internal membrane 116 includes a central portion which applies pressure to the wafer 10 in a controllable area. The volume between the base assembly 104 and the internal membrane 116 that is sealed by an inner flap 144 provides the pressurizable floating lower chamber 134. The annular volume between the base assembly 104 and the internal membrane 116 that is sealed by the inner flap 144 and outer flap 146 defines the pressurizable floating upper chamber 136.

A second pressure regulator (not shown) can be connected to direct fluid such as a gas into or out of the floating upper chamber 136. Similarly, a third pressure regulator (not shown) can be connected to direct a fluid into or out of the floating lower chamber 134. The second pressure regulator controls the pressure in the upper chamber and the vertical position of the lower chamber, and the third pressure regulator controls the pressure in the lower chamber 134. The pressure in the floating upper chamber 136 controls the contact area of the internal membrane 116 against a top surface of the external membrane 118. Thus, the second and third pressure regulators control the area of the wafer 10 against which pressure is applied, in other words the loading area, and the downward force on the substrate in the loading area.

The sealed volume between the internal membrane 116 and the external membrane 118 defines a pressurizable outer chamber 138. A fourth pressure regulator (not shown) can be connected to passage 140 to direct fluid such as a gas into or out of the outer chamber 138. The fourth pressure regulator controls the pressure in the outer chamber 138.

Figure 4:
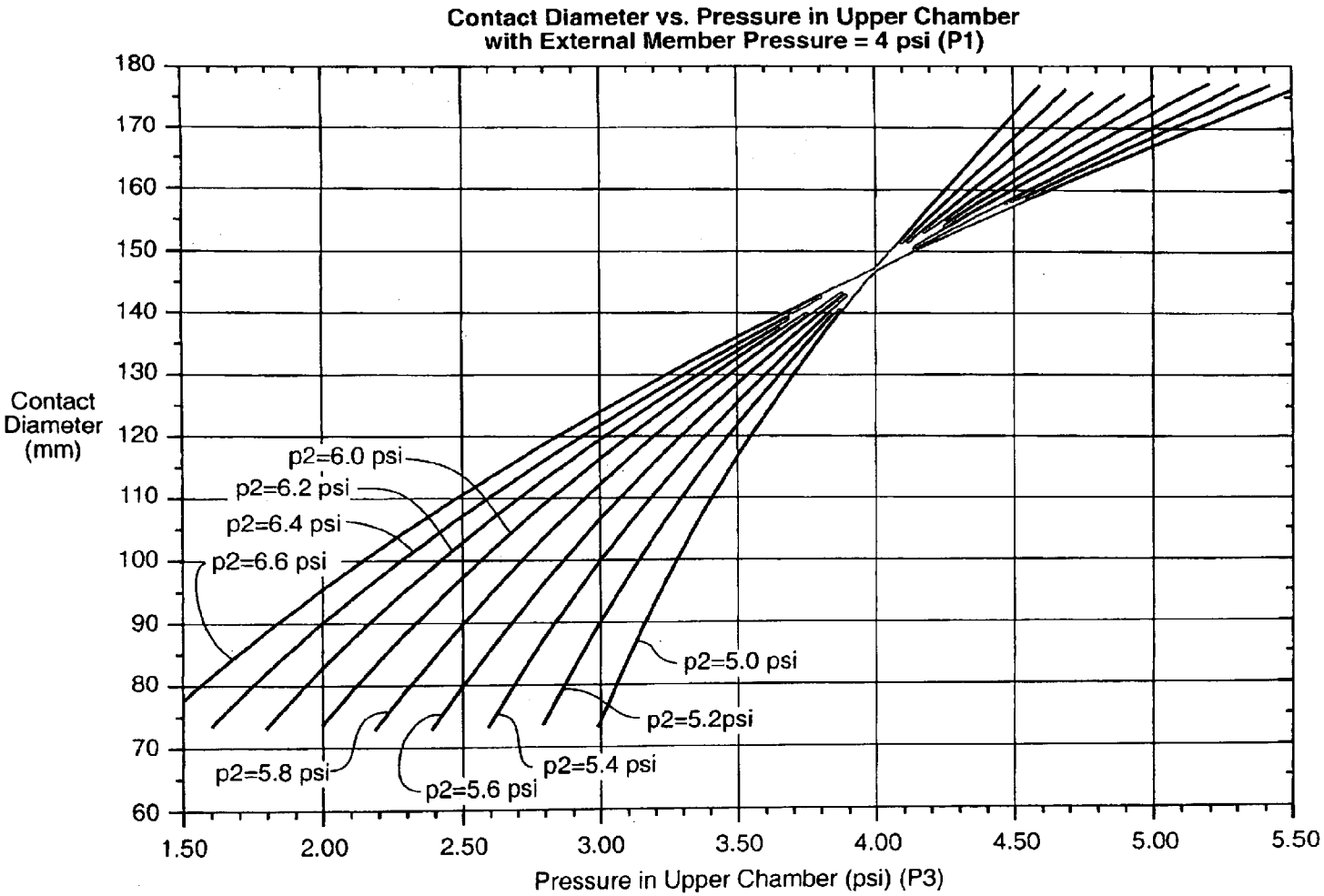
FIG. 4 is a graph illustrating how the value of a contact diameter of a membrane in the carrier head varies with the pressure in one of the carrier head chambers.

In operation, fluid is pumped into or out of the floating lower chamber 134 to control the downward pressure of the internal membrane 116 against the external membrane 118 and, therefore, against the wafer 10. Fluid is pumped into or out of the floating upper chamber 136 to control the contact area of the internal membrane 116 against the external membrane 118. Thus, the carrier head 100 is able to control both the loading area and the pressure applied to the wafer 10. FIG. 4 illustrates graphically a relationship between the pressure (P3) in the upper floating chamber 136 and the contact area of the internal membrane 116 against the external membrane 118. In FIG. 4, the external membrane pressure (P1) in the outer chamber 138 is 4 psi. The graph illustrates the contact area for various values of the internal membrane pressure (P2) in the lower floating chamber 134, ranging from 5 psi to 6.6 psi.

Figure 5:
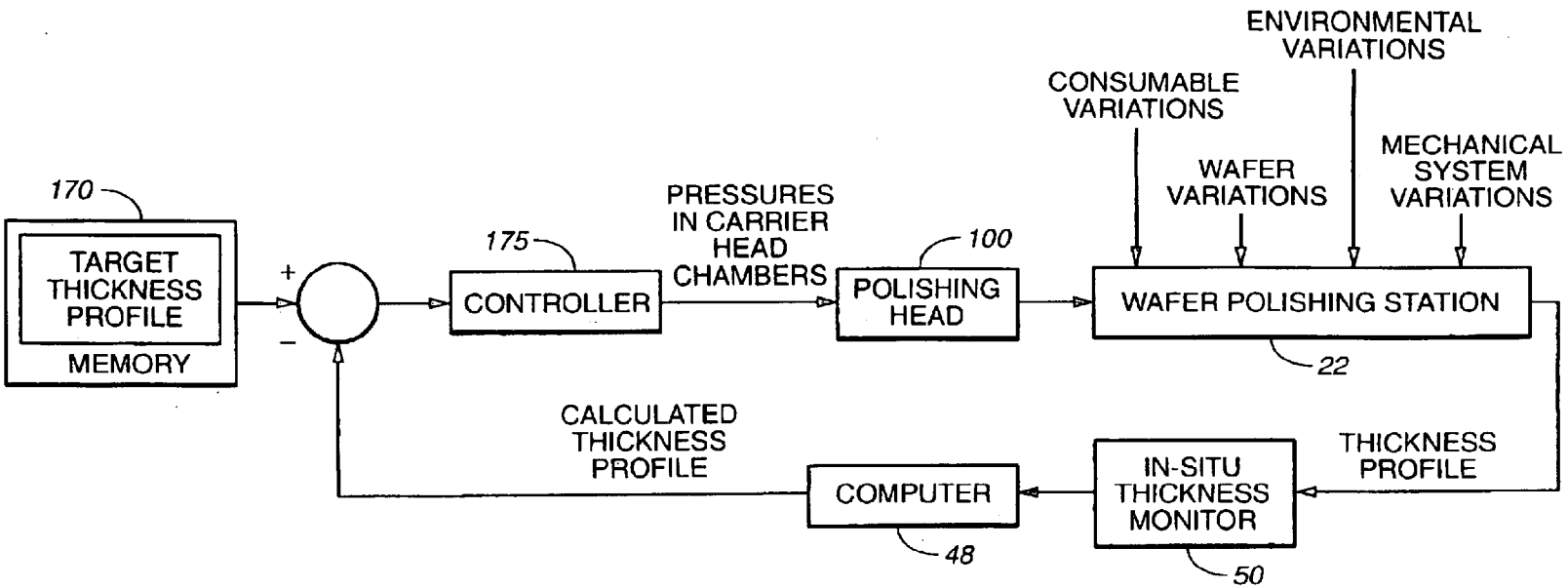
FIG. 5 is a block diagram showing a closed-loop control wafer polishing system according to the invention.
Figure 6:
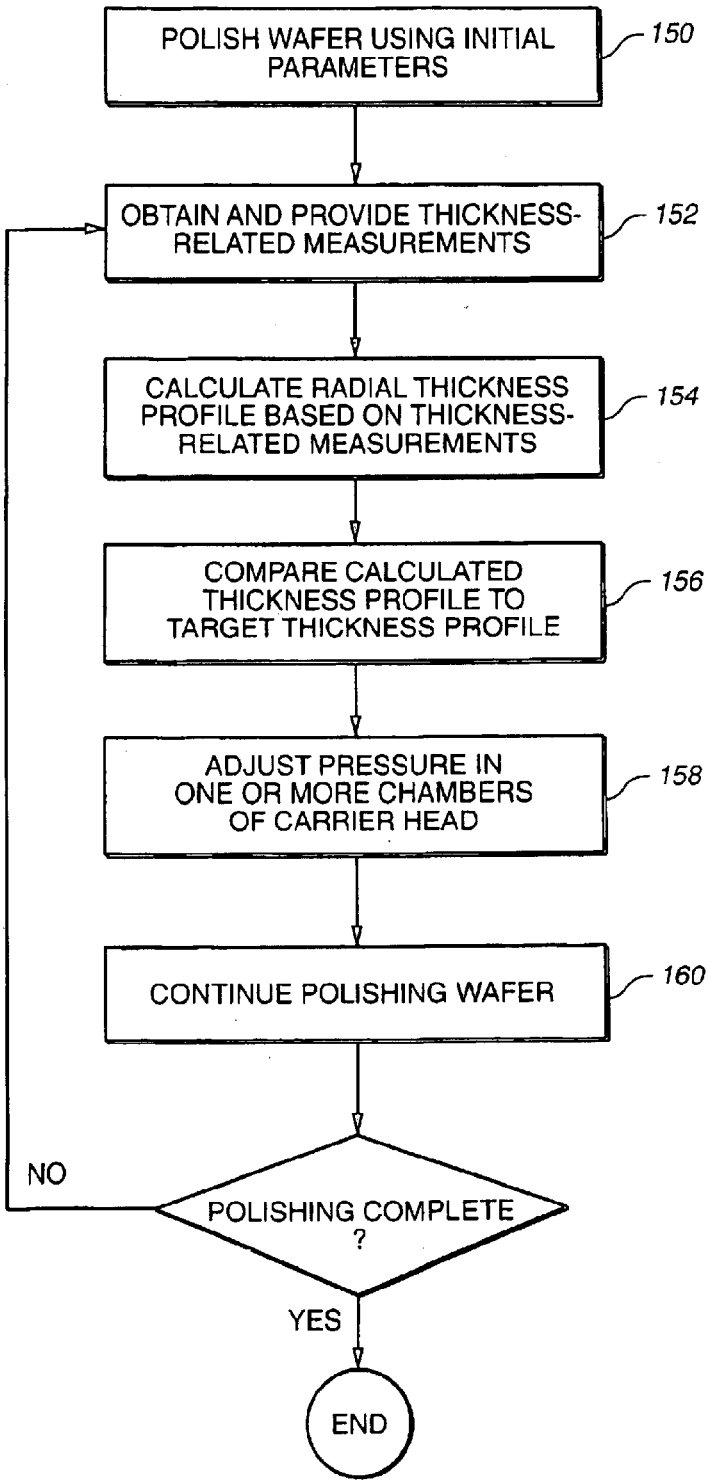
FIG. 6 is a flow chart of a method of closed-loop control wafer polishing according to the invention.

Closed-loop control of wafer polishing during the CMP process is illustrated by FIGS. 5 and 6. A wafer 10 is held by one of the carrier heads 100 and polished 150 at a station 22 using a previously determined CMP process with initial parameters. The initial parameters include the pressures in the chambers 108, 134, 136 and 138. As discussed above, other factors, including consumable variations related, for example, to the polishing pad and slurry affect the dynamics of the CMP process. Similarly, variations in the wafer, environmental variations and variations in the CMP system, affect the dynamics of the CMP process and, therefore, affect the amount of material removed from the wafer surface. Typically, such variations are not intentionally introduced into the system and are difficult to control.

As the wafer 10 is polished, a particular radial thickness profile results. At a predetermined point during the process, for example, after a predetermined time since commencement of the polishing, the in situ thickness monitor 50 provides 152 thickness-related measurements to the computer 48. The computer 48 then calculates 154 a radial thickness profile for the wafer 10 based on the measurements obtained from the thickness monitor 50. In other words, the wafer thickness at multiple positions from the wafer center to the wafer edge is calculated. In some cases, the calculated wafer thicknesses may represent average thicknesses for each radial position.

Next, the calculated thickness profile is compared 156 to a target thickness profile. The target thickness profile can be stored in memory 170, for example, EEPROM and can represent an ideal wafer thickness profile which is desired at the predetermined point in the CMP process. Alternatively, the target thickness profile can represent a thickness profile that is expected at that point in the CMP process. According to one implementation, the target profile and the calculated profile are compared by calculating a difference between the corresponding thickness values for each of the thickness profiles. For example, the thickness value in the target profile for a particular radial position can be subtracted from the corresponding thickness value in the calculated thickness profile for the same radial position. The result is a series of difference values each of which corresponds to a radial position on the wafer 10 and which represents the disparity between the target thickness and the calculated thickness at the particular radial position on the wafer. Comparing the two profiles can be performed either in hardware of software and may be performed, for example, by the computer 48.

The result of the comparison between the target thickness values and the calculated thickness values is provided to a controller 175. Although the controller 175 is illustrated separately from the computer 48, the controller and computer can be part of a single computer system that may include hardware and/or software. Such a computer system can include, for example, one or more general purpose or special purpose processors configured to perform the functions of the computer 48 and the controller 175. Instructions for causing the computer system to perform those functions can be stored on a storage medium such as read-only-memory (ROM).

In response to receiving the comparison results, the controller 175 uses the results to adjust 158 the pressure in one or more of the chambers 108, 134, 136, 138 of the carrier head 100. As discussed above, the pressures can be adjusted to change the downward pressure of the carrier head 100 exerted on the wafer and/or to change the loading area. For example, the pressures may need to be adjusted if the wafer edge is being polished at a different rate than the wafer center or if the wafer center is being underpolished. In particular, if the center of the wafer is being underpolished, the chamber pressures can be adjusted to reduce the radius of the loading area. In other words, the product of the pressure and polishing time at the center of the wafer is greater than at areas near the wafer edge, thereby compensating for the underpolishing. After adjusting the chamber pressures, polishing of the wafer 10 continues 160 until the in situ thickness monitor indicates that the wafer is substantially planarized or until some other CMP end-point is reached.

The closed-loop feedback control illustrated above can be performed one or more times during CMP polishing of a particular wafer. In other words, the pressures in the carrier head chambers can be adjusted based on thickness-related measurements once or multiple times during the CMP process. For example, closed-loop adjustments to the chamber pressures can be performed at some regular interval, such as once every fifteen seconds, during the CMP process.

In some implementations, it may be desirable to perform the closed-loop control for each wafer as it is polished. In other situations, it will be sufficient to perform the closed-loop control for one or more test wafers. The adjustments to the carrier head chamber pressures obtained for the test wafers can subsequently be used during CMP polishing of an entire batch of wafers.

The thickness-profile can be obtained after a period of time T(n) to determine whether the desired amount of material was removed. If the desired amount of material was not removed from the wafer, then the polishing time can be extended by a small unit of time, such as one second. The process can be repeated until the desired amount of material has been removed.

In one implementation, a sample wafer is polished in a standard operating mode in which the floating chambers 134, 136 are depressurized, and the outer chamber 138 is pressurized to apply a uniform pressure to the entire backside of the wafer. The sample wafer is then polished and, after a predetermined period of time, thickness-related measurements of multiple radial zones of the sample wafer are obtained and converted to a radial thickness profile. The thickness profile is compared to a target profile, for example, a substantially flat profile, and a differential thickness $\Delta t_n$ is obtained for each radial zone n on the wafer. Each differential thickness $\Delta t_n$ represents the difference between the measured thickness and the target thickness for the $n^{th}$ zone.

Based on the measured thicknesses of the wafer, a removal factor (RF) expressed in units of Å/psi/second and indicating an average rate of removal of material from the wafer can be obtained. A differential pressure ΔP, which equals the difference in pressure between the external membrane pressure (P1) in the chamber 138 and the internal membrane pressure (P2) in the chamber 134, is selected. Typical examples of the differential pressure ΔP are in the range of about one to several psi. Assuming N radial zones on the wafer and assuming that the first zone (n=1) is closest to the wafer center and the $N^{th}$ zone is closest to the wafer edge, the durations $T_n$ for which the various regions of subsequent wafers should be polished using the specified pressure differentials $\Delta P_n$ to correct the thickness profile can be calculated as follows:

$$T_n=[\Delta t_n/(\Delta P_n \cdot RF)]-[(T_{(n+1)} \cdot \Delta P_{(n+1)}/\Delta P_{(n)})+(T_{(n+2)} \cdot \Delta P_{(n+2)}/\Delta P_{(n)})+\ldots+(T_{(N)} \cdot \Delta P_{(N)}/\Delta P_{(n)})].$$

In situations where the pressure differential is constant, the foregoing equation reduces to:

$$T_n=[\Delta t_n/(\Delta P_n \cdot RF)]-(T_{(n+1)}+T_{(n+2)}+\ldots+T_{(N)}).$$

Figure 8:
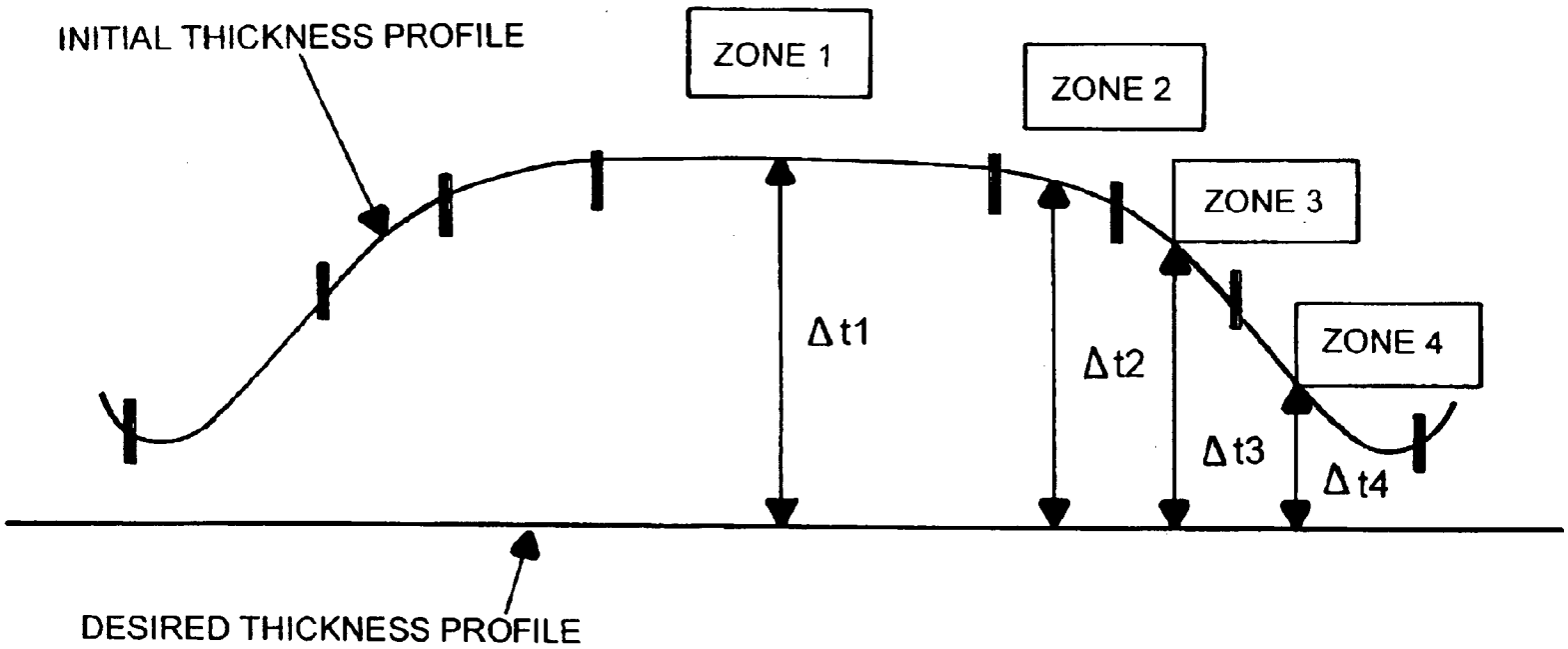
FIG. 8 shows exemplary zones on a wafer.

For example, referring to FIG. 8, if there are four zones (N=4), then $$T_4=[\Delta t_4/(\Delta P_4 \cdot RF)],$$

$$T_3=[\Delta t_3/(\Delta P_3 \cdot RF)]-T_{(4)},$$

$$T_2=[\Delta t_2/(\Delta P_2 \cdot RF)]-(T_{(3)}+T_{(4)}), \text{ and}$$

$$T_1=[\Delta t_1/(\Delta P_1 \cdot RF)]-(T_{(2)}+T_{(3)}+T_{(4)}).$$

Figure 7:
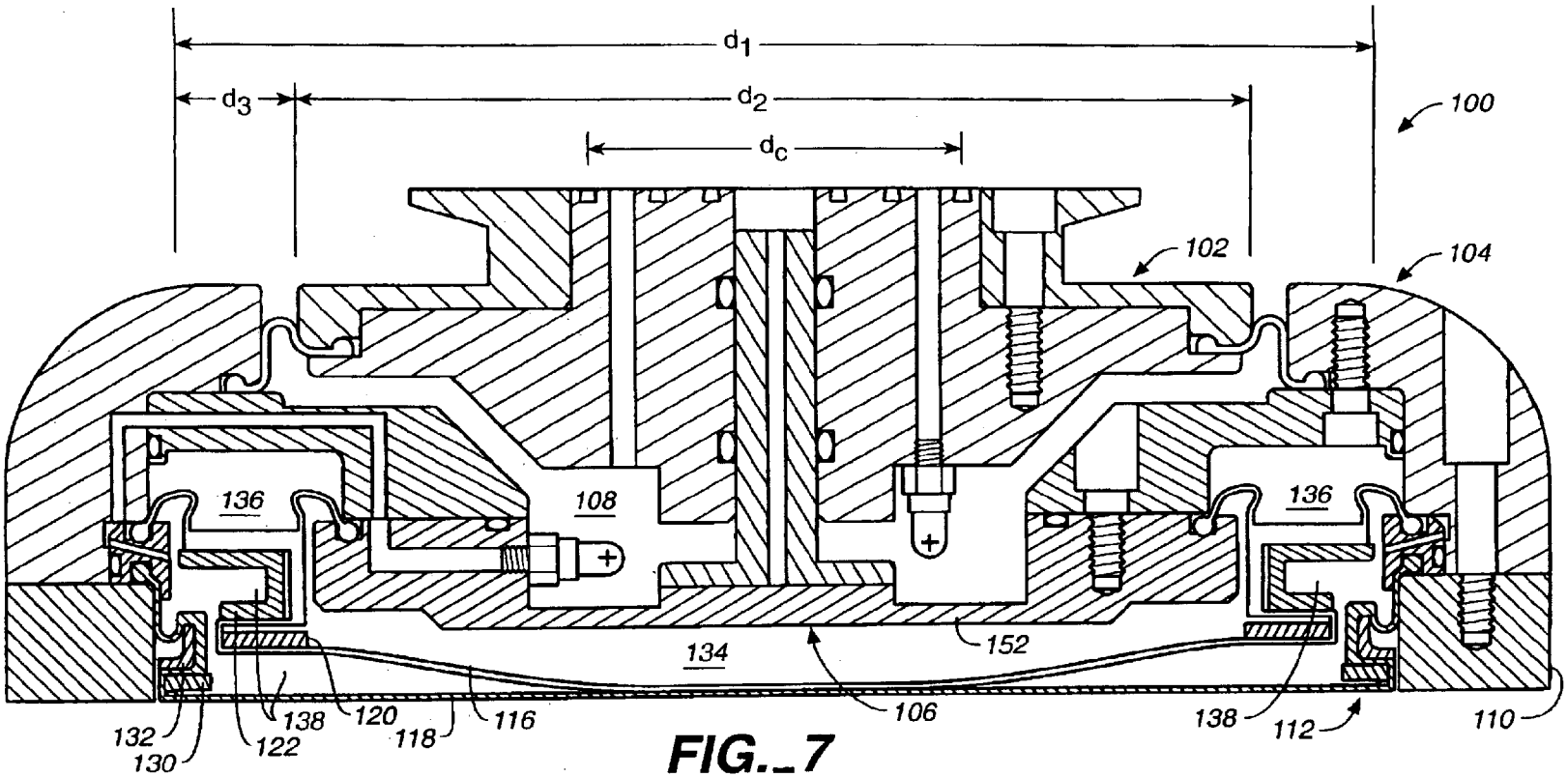
FIG. 7 illustrates various dimensions of the carrier head.

The pressure (P3) in the upper floating chamber 136 can then be selected so that the loading area extends from the wafer center to the radial position of the first zone (n=1) for a duration $T_1$, the loading area extends from the wafer center to the radial position of the second zone (n=2) for a duration $T_2$, the loading area extends from the wafer center to the radial position of the third zone (n=3) for a duration $T_3$, and the loading area extends from the wafer center to the radial position of the fourth zone (n=4) for a duration $T_4$. The pressure (P3) in the upper floating chamber 136 can be approximated as follows:

$$P3=((P2-P1)A_C+P1A_1-P2A_2)/A_3,$$

where the loading area $A_C=\pi(d_C)^2/4$, and $A_1=\pi(d_1)^2/4$, $A_2=\pi(d_2)^2/4$, and $A_3=\pi(d_3)^2/4$. As shown in FIG. 7, $d_1$, $d_2$ and $d_3$ are diameters corresponding, respectively, to the outer chamber 138, the lower floating chamber 134 and the upper floating chamber. Using the new pressures and polishing times, a more planar surface can be obtained.

In some implementations, the carrier head can include multiple concentric chambers that can apply independently variable pressures to multiple concentric regions of the wafer. Such a carrier head is discussed in U.S. Pat. No.

5,964,653, incorporated herein by reference in its entirety. During polishing, the pressure in each chamber can be adjusted based on the measured polishing rate or amount removed in the radial zone associated with that chamber. For example, if the optical monitoring system determines that the edge of the wafer is being polished faster than the center of the substrate, the pressure to the outermost chamber of the carrier head can be reduced during the polishing operation. The techniques described above can be used to monitor a film thickness and to adjust a pressure in one or more of the carrier head chambers based on a comparison of the measured thicknesses with a target thickness profile. That can significantly improve the polishing uniformity.

The invention has been described in terms of a number of implementations. The invention, however, is not limited to the implementations depicted and described. Other implementations are within the scope of the following claims.

What is claimed is:

1. A method of polishing a wafer held by a carrier head having at least one first chamber whose pressure can be controlled to control a size of a loading area on the wafer and at least one second chamber whose pressure can be controlled to apply a downward force across the loading area on the wafer, the method comprising:

obtaining thickness-related measurements of the wafer during polishing;

calculating a thickness profile for the wafer based on the thickness-related measurements;

comparing the calculated thickness profile to a target thickness profile; and adjusting a pressure in the at least one first carrier head chamber and a pressure in the at least one second carrier head chamber based on the results of the comparison.

2. The method of claim 1 further including holding the wafer against a polishing surface, wherein adjusting a pressure in the at least one second carrier head chamber changes a pressure distribution between wafer and the polishing surface during polishing.

3. The method of claim 1 further including holding the wafer against a polishing surface, wherein adjusting a pressure in the at least one second carrier head chamber changes the downward force with which the wafer is pressed against the polishing surface during polishing.

4. The method of claim 1 wherein the carrier head includes a flexible membrane which provides a pressure to the wafer in the loading area, and wherein adjusting a pressure in the at least one second carrier head includes adjusting a pressure in a pressurizable chamber to control the pressure applied to the wafer in the loading area.

5. The method of claim 1 wherein the carrier head includes a membrane which provides a pressure to the wafer in the loading area, and wherein adjusting a pressure in the at least one second carrier head includes adjusting a pressure in a pressurizable chamber to control the downward force with which the wafer is pressed against a polishing surface.

6. The method of claim 1 further including repeatedly obtaining thickness-related measurements, calculating a thickness profile, comparing the calculated thickness profile to a target thickness profile, and adjusting a pressure in the at least one second carrier head chamber of the carrier head with respect to the wafer.

7. The method of claim 1 wherein the carrier head includes a membrane which provides a pressure to the wafer in the loading area, and wherein, if comparing the calculated thickness profile to a target thickness profile indicates that a center region of the wafer is being underpolished, then a pressure in at least one first carrier head chamber is adjusted to reduce the size of the loading area.

8. The method of claim 1 wherein obtaining thickness-related measurements of the wafer includes measuring intensities of reflected radiation from a plurality of sampling zones on the wafer.

9. The method of claim 1 wherein the target thickness profile represents an ideal thickness profile for a particular time in the polishing process.

10. The method of claim 1 wherein the target thickness profile represents an expected thickness profile for a particular time in the polishing process.

11. A method of polishing a wafer held by a carrier head having at least one chamber whose pressure can be controlled to apply a downward force on the wafer, the method comprising:

holding a first wafer in the carrier head and pressing the first wafer against a polishing surface;

obtaining thickness-related measurements of the first wafer during polishing;

calculating a thickness profile for the first wafer based on the thickness-related measurements;

comparing the calculated thickness profile to a target thickness profile; and adjusting a pressure in at least one carrier head chamber based on results of the comparison so as to affect the size of an area of a subsequently polished wafer to which a downward force is applied during polishing.

12. A method of polishing a wafer held by a carrier head having multiple chambers that can apply independently variable pressures to multiple regions of the wafer, the method comprising:

obtaining thickness-related measurements of a first wafer during polishing; and adjusting a pressure in one of the carrier head chambers associated with a particular zone of a subsequently polished wafer based on the thickness-related measurements.

13. A chemical mechanical polishing system comprising:

a wafer polishing surface;

a carrier head for holding a wafer, wherein the carrier head includes at least one first chamber whose pressure can be controlled to control a size of a loading area on the wafer and at least one second chamber whose pressure can be controlled to apply a downward pressure across the loading area on the wafer as it is polished against the polishing surface;

a monitor for obtaining thickness-related measurements of the wafer during polishing;

memory that stores a target thickness profile; and a processor configured to:

(a) calculate a thickness profile for the wafer based on a thickness-related profile obtained by the monitor;

(b) compare the calculated thickness profile to a target thickness profile; and (c) adjust a pressure in the at least one second carrier head chamber based on results of the comparison.

14. The system of claim 13 wherein the carrier head includes a flexible membrane which provides a pressure to the wafer in the loading area, and wherein the processor is configured to adjust a pressure in the at least one second chamber to control the pressure applied to the wafer in the loading area based on the comparison results.

15. The system of claim 13 wherein the carrier head includes a membrane which provides a pressure to the wafer in the loading area, and wherein the processor is configured to adjust a pressure in the at least one first chamber to control the size of the loading area based on the comparison results.

16. The system of claim 13 wherein the target thickness profile stored in the memory represents an ideal thickness profile for a particular time in the polishing process.

17. The system of claim 13 wherein the target thickness profile stored in the memory represents an expected thickness profile for a particular time in the polishing process.

18. The system of claim 13 wherein the monitor is arranged to obtain measurements of reflected radiation from a plurality of sampling zones on the wafer during polishing.

19. An article comprising a computer-readable medium that stores computer-executable instructions for causing a computer system to:

obtain thickness-related measurements of a wafer during polishing;

calculate a thickness profile for the wafer based on the thickness-related measurements;

compare the calculated thickness profile to a target thickness profile;

adjust a pressure in a first carrier head chamber based on results of the comparison to adjust a size of a loading area on the wafer; and adjust a pressure in a second carrier head chamber based on results of the comparison to adjust a downward force across the loading area on the wafer.

20. The article of claim 19 including instructions for causing the computer system to adjust a pressure in the second carrier head chamber to control a pressure applied by a flexible membrane to wafer in a controllable loading area.

21. The article of claim 19 including instructions for causing the computer system to repeatedly:

obtain thickness-related measurements for the wafer during polishing;

calculate a thickness profile based on the thickness-related measurements;

compare the calculated thickness profile to a target thickness profile; and adjust the pressure in the first and second carrier head chambers based on the comparison.

22. An article comprising a computer-readable medium that stores computer-executable instructions for causing a computer system to:

obtain thickness-related measurements during polishing of a first wafer held by a carrier head having multiple chambers that can apply independently variable pressures to multiple regions of the first wafer; and adjust a pressure in one of the carrier head chambers associated with a particular zone of a subsequently polished wafer based on the thickness-related measurements.

* * * * *